US005335519A

United States Patent [19]

Bernier

[11] Patent Number: 5,335,519

[45] Date of Patent: Aug. 9, 1994

[54] PLANT FOR PRODUCING COLD BY SOLID/GAS REACTION, REACTOR COMPRISING MEANS OF COOLING

[75] Inventor: Jacques Bernier, Houilles, France

[73] Assignee: Societe Nationale Elf Aquitaine, France

[21] Appl. No.: 30,133

[22] PCT Filed: Jul. 24, 1992

[86] PCT No.: PCT/FR92/00736

§ 371 Date: May 24, 1993

§ 102(e) Date: May 24, 1993

[87] PCT Pub. No.: WO93/03314

PCT Pub. Date: Feb. 18, 1993

[30] Foreign Application Priority Data

Jul. 26, 1991 [FR] France ..... 91 09498

[51] Int. Cl.[5] ..... F25B 17/08; F25B 35/04

[52] U.S. Cl. ..... 62/481; 62/482

[58] Field of Search ..... 62/480, 481, 482, 476, 62/101

[56] References Cited

U.S. PATENT DOCUMENTS

| | | | |
|---|---|---|---|
| 1,954,056 | 4/1934 | Miller | 62/118 |
| 2,236,575 | 9/1939 | Kogel | 62/5 |
| 2,269,099 | 1/1942 | Grubb | 62/5 |
| 2,276,947 | 3/1942 | Erland Af Kleen | 62/5 |
| 2,287,172 | 6/1942 | Harrison et al. | 62/5 |
| 2,293,556 | 8/1942 | Newton | 62/480 |
| 2,340,887 | 2/1944 | Erland Af Kleen | 62/481 |
| 2,370,643 | 3/1945 | Erland Af Kleen | 62/5 |
| 2,452,635 | 11/1948 | Coons | 62/5 |
| 2,461,262 | 2/1949 | Erland Af Kleen | 62/5 |
| 2,587,996 | 3/1952 | Gross | 62/5 |
| 4,548,046 | 10/1985 | Brandon et al. | 62/79 |
| 4,581,049 | 4/1986 | Januschkowetz | 55/208 |
| 4,694,659 | 9/1987 | Shelton | 62/106 |
| 4,976,117 | 12/1990 | Crozat et al. | 62/480 |

FOREIGN PATENT DOCUMENTS

| | | | |
|---|---|---|---|
| 630064 | 5/1936 | Fed. Rep. of Germany | 17A/9 |
| 730660 | 8/1932 | France | 15/4 |

*Primary Examiner*—Henry A. Bennett
*Assistant Examiner*—William C. Doerrler
*Attorney, Agent, or Firm*—Bacon & Thomas

[57] ABSTRACT

A cooling plant bringing into play a reaction between a solid and a gas, comprises at least two solid-containing reactors connected to an evaporator and a condensor by means of tubes in which the gas flows. Means are provided for cooling the reactor. Said means comprise a heat exchanger filled with a refrigerating agent and connected by tubes to a condensor in heat exchange arrangement with a fan.

12 Claims, 4 Drawing Sheets

PLANT FOR PRODUCING COLD BY SOLID/GAS REACTION, REACTOR COMPRISING MEANS OF COOLING

BACKGROUND OF THE INVENTION

1. Technical Field of the Invention

The present invention relates to a plant for producing cold, using a solid and a gas (or fluid).

2. Description of the Prior Art

The known plant uses, for example, a reaction between a salt such as $MnCl_2$ and a gas such as ammonia ($NH_3$), as described, for example, in French Patent 2,615,601.

This plant comprises one or a number of reactors containing the solid, which are connected to an evaporator and a condenser by tubing in which the gas circulates.

The advantage of a plant of this type lies in the fact that the source of heat needed for its operation can be provided by heat energy, in contrast to conventional compressor refrigeration plants.

Plants with a solid/gas reaction of the above-mentioned type comprise finned reactors interacting with fans for cooling them.

This method of cooling presents especially the following disadvantages:

- it increases the thermal inertia of the reactor and the heat losses during the stage of heating the reactor,
- it increases the bulk of the plant, especially since each reactor must be used in combination with a fan,
- it does not make it possible to obtain a compact plant which can be arranged anywhere, because of the presence of the fans.

The invention can also be applied to plants for the production of cold using adsorption between a solid such as a zeolite and a fluid such as water.

The objective of the present invention is to overcome the disadvantages of the above known refrigeration plants.

SUMMARY OF THE INVENTION

The invention thus relates to a plant for producing cold, using a solid and a gas, comprising at least one vessel containing the solid and connected to an evaporator and a condenser by tubing in which the gas circulates, means being provided for ensuring the cooling of the vessel.

According to the invention the said means comprise an exchanger capable of heat exchange with the solid contained in the vessel, this exchanger being filled with a refrigerant fluid and being connected by tubing to a condenser which is cooled.

According to a preferred version the equipment is characterized in that the said means comprise an enclosure surrounding the wall of the reactor and defining with the latter a vessel filled with a refrigeration fluid and connected by tubing to a condenser which is capable of heat exchange with a fan or a water cooling circuit.

The cooling of the reactor is thus ensured by the refrigerant fluid which circulates in the vessel surrounding the reactor or in an internal exchanger, this fluid itself being cooled in the condenser.

The plant according to the invention thus introduces the following advantages:

The thermal inertia of the reactor is much lower than in finned reactors cooled by a fan.

During the stage of heating of the reactor the heat losses are decreased.

A single condenser exchanger can cool a number of reactors, and this makes it possible to reduce the bulk of the plant.

In addition, the removal of heat can be located anywhere, and this makes it easier to fit the plant in, for example in a road vehicle.

The enclosure defining a vessel around the reactor ensures a heat insulation which, in addition to reducing heat losses, prevents, in the case of a very low external temperature, the salt contained in the reactor from being at an insufficient temperature in relation to the thermal equilibrium.

Furthermore, the elimination of the fans associated with each reactor reduces the energy costs and the operating noise.

According to an advantageous version of the invention the said condenser is connected to the vessel by a first tubing communicating with the lower part of the vessel and fitted with a valve, a second tubing being connected to the upper part of the vessel.

In a first embodiment of the invention the said condenser connected to the vessel is separate from the condenser which is connected to the reactor and to the evaporator.

In a preferred embodiment of the invention the said refrigerant fluid is the same as than employed for making use of the solid/gas reaction in the reactor.

This fluid may be ammonia when a reaction between a salt such as $MnCl_2$ and $NH_3$ is involved.

In this embodiment the plant comprises only a single condenser, the reactor cooling vessel being connected to this condenser by tubing which communicates with the upper part of this vessel.

Thus, the condenser employed for cooling the reactor(s) is the same as that which is normally already provided in the equipment. It suffices for this condenser to be oversized.

The above version of the plant is thus of very simple design. In addition, it comprises only a single fluid, namely ammonia, and this facilitates refilling operations.

In addition, ammonia offers the advantage of exhibiting a high latent heat of vaporization and does not present any risk of freezing or of decomposition over a very wide range of temperatures.

Other special features and advantages of the invention will appear further in the description below.

BRIEF DESCRIPTION OF THE FIGURES OF DRAWINGS

In the attached drawings, given by way of examples without any limitation being implied:

FIG. 1 is the diagram of a first version of a refrigeration plant according to the invention, FIG. 2 is the diagram of a second version of a refrigeration plant according to the invention, FIG. 3 is the diagram of a third version of a refrigeration plant, FIG. 4 is the diagram of a refrigeration plant with three reactors, FIG. 5 is the diagram of another refrigeration plant with three reactors.

DETAILED DESCRIPTION OF THE PREFERRED EMBODIMENTS

Figure 1:
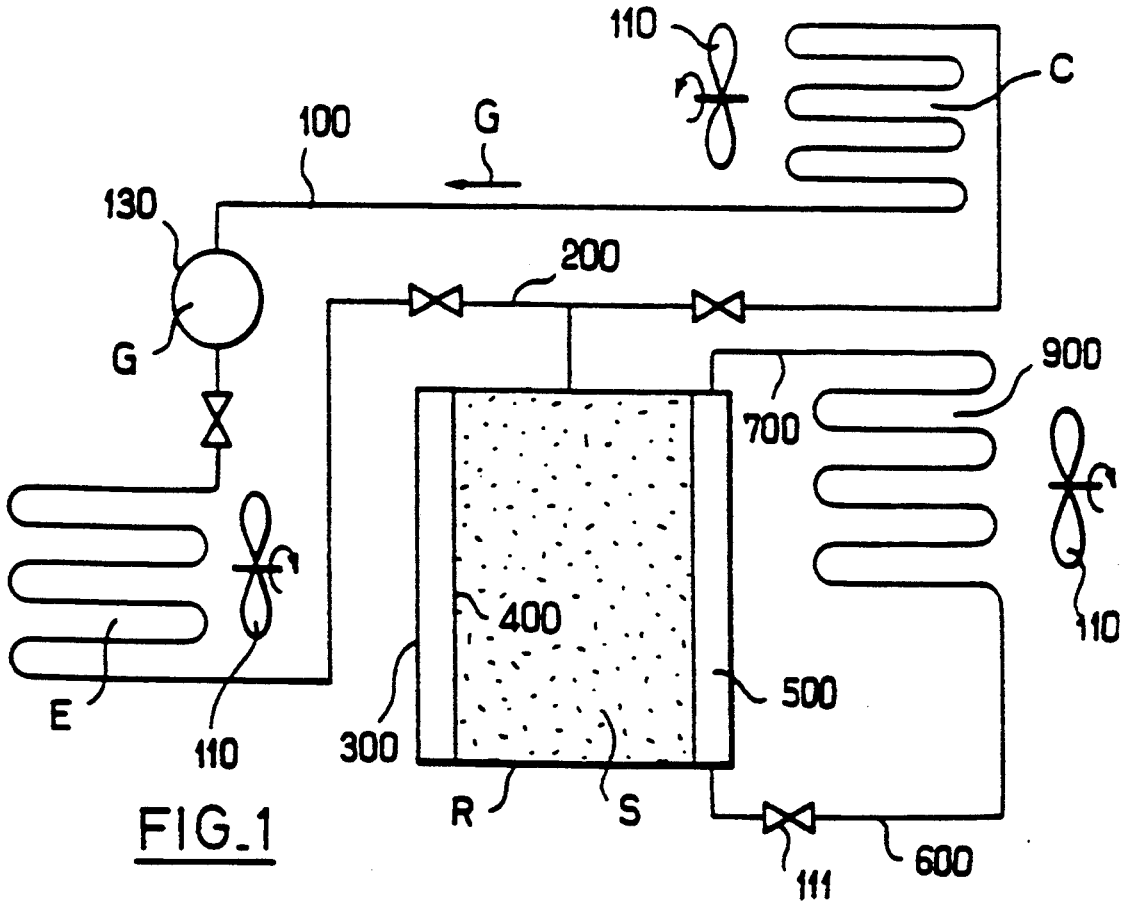

In the embodiment of FIG. 1 the plant for producing cold, using a reaction between a solid and a gas, comprises a reactor R containing the solid S and connected to an evaporator E and a condenser C by tubing 100, 200 in which a fluid G circulates.

The means for ensuring the cooling of the reactor R comprise an enclosure 300 surrounding the wall 400 of the reactor R and defining with the latter a vessel 500 filled with a refrigerant fluid and connected by tubing 600, 700 to a condenser 900 which is capable of heat exchange with a fan 110. A fan 110 is also used in combination with the evaporator E and the condenser C.

The vessel 500 thus forms an evaporator.

The condenser 900 is connected to the vessel 500 by a first tubing 600 communicating with the lower part of the vessel 500 and fitted with a valve 111, a second tubing 700 being connected to the upper part of the vessel 500.

In the example of FIG. 1 the condenser 900, connected to the vessel 500, is separate from the condenser C which is connected to the reactor R and to the evaporator E. The vessel 500 and the condenser 900 thus replace the cooling fan of the known reactors.

When compared with the method of cooling using fins, the implementation of FIG. 1 introduces the following advantages:

lower thermal inertia,
reduction in heat losses,
possibility of cooling a number of reactors by means of a single exchanger-condenser,
reduction in the bulk of the plant,
possibility of discharging the heat anywhere,
thermal insulation of the reactor,
reduction in the operating cost and noise.

Figure 2:
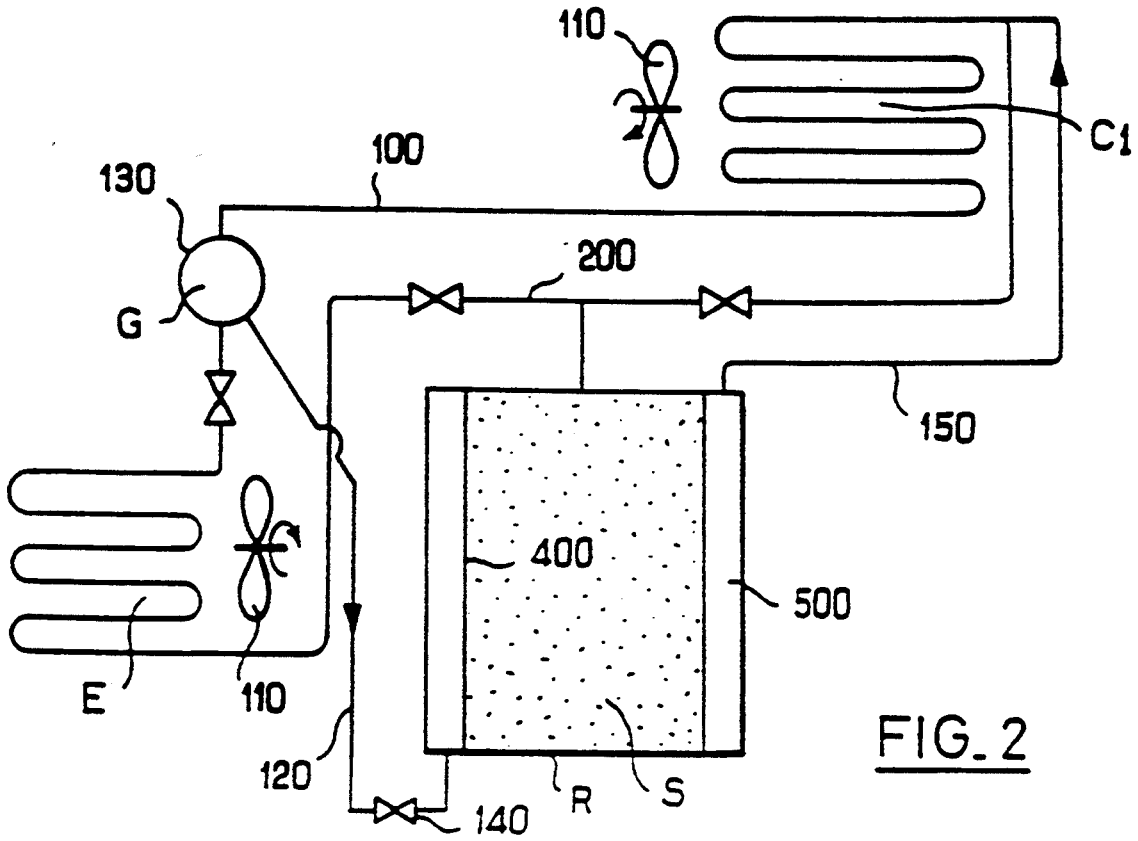

In the version shown in FIG. 2 the refrigerant fluid C which circulates in the vessel 500 is the same as that employed for use in the reactor R for the solid/gas reaction.

In this example the vessel 500 of the reactor R is connected by a tubing 120 to the tank 130 for storing the said fluid G, situated between the evaporator E and the condenser $C_1$. This tubing 120 is fitted with a valve 140 and communicates with the lower part of the vessel 500.

In the example of FIG. 2, the plant comprises only a single condenser $C_1$. The vessel 500 for cooling the reactor R is connected to a condenser $C_1$ by a tubing 150 which communicates with the upper part of this vessel.

The single condenser $C_1$ has a heat exchange capacity which is higher than that (condenser C in FIG. 1) employed when the cooling of the reactor R is ensured by means of a separate condenser.

In the example of FIG. 2, the refrigerant fluid employed for cooling the reactor R is ammonia.

When compared with the embodiment of FIG. 1, that shown in FIG. 2 introduces the following advantages:

reduction in the cost, because of the replacement of two condensers used in combination with two fans by a single condenser and fan,
reduction in bulk,
greater ease of management because of the use of a single refrigerant fluid.

Figure 3:
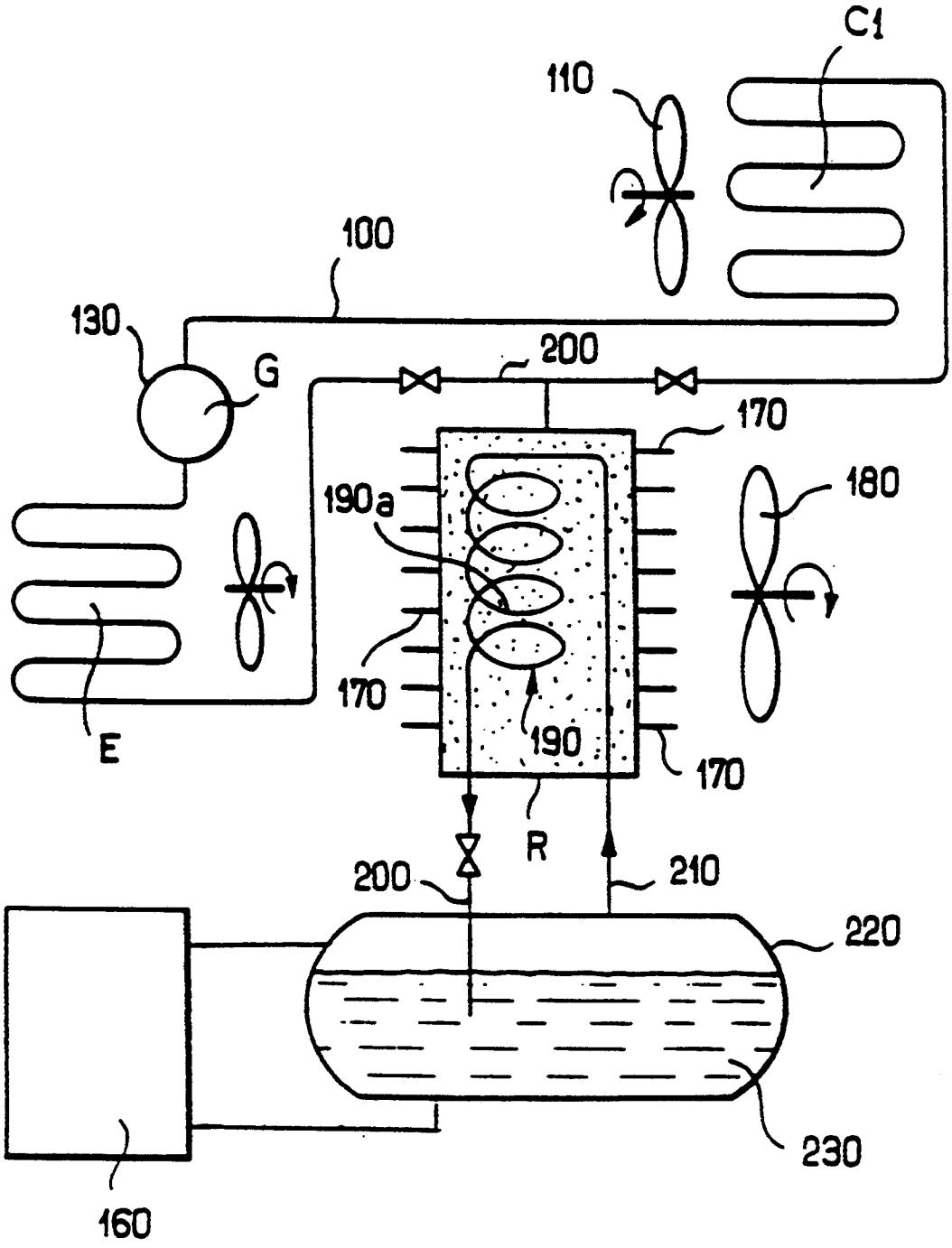

In the embodiment shown in FIG. 3 the plant comprises an external source of energy 160 for heating the reactor R. In this example the reactor R comprises cooling fins 170 used in combination with a fan 18.

Inside the reactor R are provides means of heat exchange 190 which communicate by tubing 200, 210 with a tank 220 filled with a heat transfer or fluid 230 which is heated by the external source of energy 160.

In this example the means of heat exchange 190 consist of tubing 190*a* forming a coil inside the reactor R.

The heat transfer fluid 230 is heated so as to form an equilibrium between the liquid and vapor phase, fluid circulation in the means of heat exchange 190 taking place by thermal syphon.

The fluid is preferably water heated to approximately 200° C. at a pressure of approximately $15\times10^3$ pascals.

When the plant is provided on a vehicle with a heat engine, the source of energy 160 may be provided by heat recovery from the exhaust of the heat engine. This source of energy may, however, consist of a gas or fuel oil burner, an electrical resistance or a solar heat sensor.

The advantages of the plant shown in FIG. 3 are the following:

elimination of pumps for circulating the fluid between the external source of energy and the reactor,
reduction in bulk,
decrease in the operating cost,
great uniformity of temperature within the reactor,
excellent heat exchange.

In the case of the plant according to FIG. 3 the fins of the reactor may, of course, be replaced by an exchanger evaporator identical with that shown in FIGS. 1 and 2.

Figure 4:
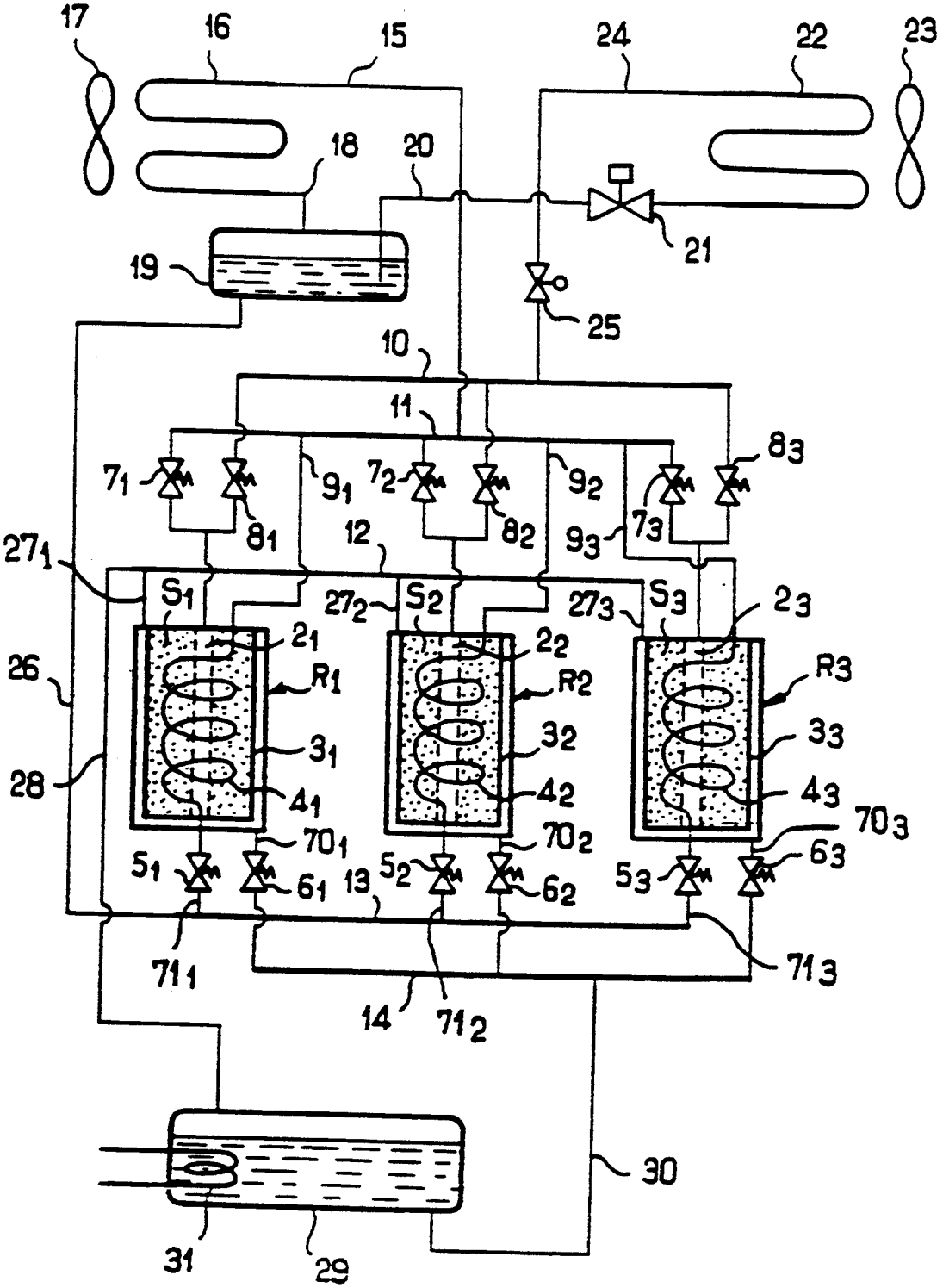

In the embodiment of FIG. 4 the refrigeration plant comprises three solid/gas reactors R1, R2, R3, each containing a salt $S_1$, $S_2$, $S_3$ such as manganese chloride. Each reacher comprises an entry/exit for ammonia gas $2_1$, $2_2$, $2_3$.

The operation of the plant comprises the following three stages:

Stage 1

The reactor R1 receives heat energy via the exchanger $3_1$ which surrounds the reactor. This heat energy originates from the source of heating 31. The latter may give rise to boiling of a liquid (for example water) contained in a pressurized tank 29. The steam formed flows through the piping 28 and moves towards the manifold 12. This steam at a temperature of the order of 180° C. enters via the pipework 27 the exchanger $3_1$ of the reactor R1, where it condenses while heating the reactor. The condensed water next flows to the exit of the reactor through the magnetic valve $6_1$ which is in an open position and moves under gravity towards the manifold 14 which returns the water to the tank 29 through the pipework 30 to form a new cycle. During this stage of heating of the reactor R1 the magnetic valve $7_1$ is open, allowing ammonia to desorb from the reactor R1. The ammonia gas moves towards the condenser 16 through the intermediacy of the manifold 11 and the pipework 15. There, the gas condenses under the cooling effect of the external air, with the aid of the fan 17. The liquid formed is conveyed into the reserve tank 19 by the pipework 18.

With the reactor R2 in an absorption stage, the magnetic valve $8_2$ is open, and this creates a suction of ammonia at low temperature from the evaporator 22 towards the entry $2_2$ of the reactor R1, The evaporator 22 is fed with liquid ammonia through the intermediacy of an expansion device 21. The valve 25 is a control valve which makes it possible to control the evaporation temperature in the evaporator 22 and consequently the production of cold. The stage of absorption of ammonia by the salt in the reactor R2 is exothermic, and this makes it necessary to remove the heat produced through the intermediacy of the exchanger $4_2$ from the reactor, the magnetic valve $5_3$ then being in open position. The exchanger $4_2$ is fed at the bottom with liquid ammonia delivered under gravity from the bottle 19 by virtue of the pipework 26 and manifold 13. The liquid vaporizes in the exchanger $4_2$ and the vapor formed is recovered at the exit of the exchanger by the pipework $9_3$, which directs it towards the condenser 16 through the intermediacy of the manifold 11 and the pipework 15. Gaseous ammonia condenses in the condenser 16 by virtue of the cooling by the external air which circulates therein with the aid of the fan 17. The liquid formed returns to the tank 19 to form a new cycle.

The reactor R3 is in a cooling stage.

The valve $5_3$ is open and the exchanger $4_3$ receives liquid ammonia originating from the tank 19. The liquid vaporizes therein, thus cooling the reactor from 180° C. to the condensation temperature of the condenser 16. The vapor flows through the pipework $9_3$ and therefore moves into the condenser 16 through the intermediacy of the manifold 11 and the pipework 15.

Stage 2

The reactor R1 is in a cooling stage.
The reactor R2 is in a heating stage.
The reactor R3 is in an absorption stage.

Stage 3

The reactor R1 is in an absorption stage.
The reactor R2 is in a heating stage.
The reactor R3 is in a cooling stage.

During stages 2 and 3 the corresponding valves of the reactors are open, as already indicated in Stage 1.

The heat energy received by the exchanger 31 may be provided either by a gas or fuel oil burner or by any other source of heat at a sufficient temperature.

Figure 5:
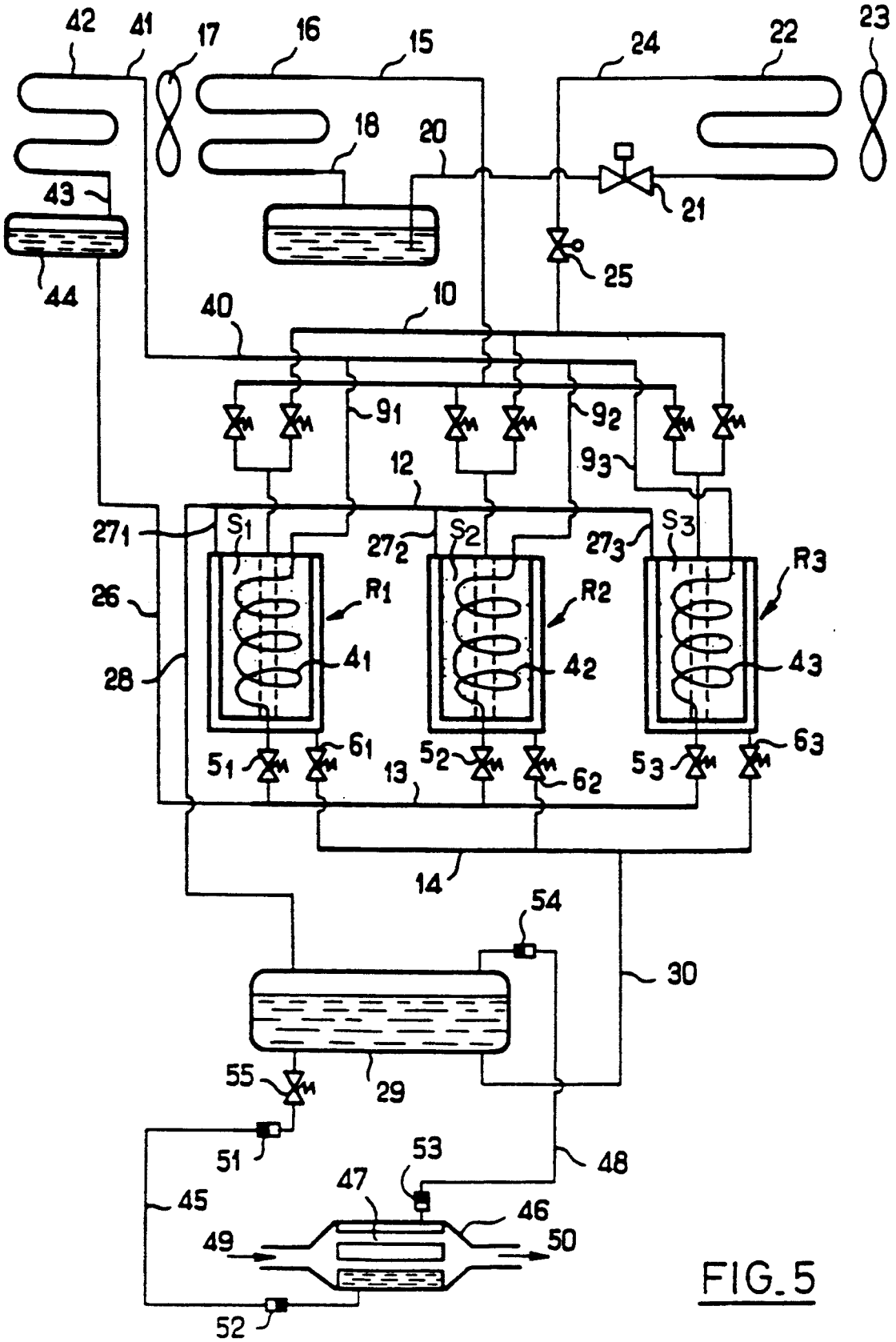

In the alternative form shown in FIG. 5 the circuit for cooling the reactors R1, R2 and R3 is independent of the refrigeration circuit. In this case the plant comprises a second condenser 42. The pipework $9_1$, $9_2$, $9_3$ at the exit from the exchangers $4_1$, $4_2$, $4_3$ is connected to a manifold 40 which is connected to the top part of the condenser 42 by the pipework 41. The liquid formed in the condenser 42 overflows into another tank 44 via the pipework 43. In this case the pipework 26 is connected to this tank 44 and makes it possible to feed liquid to the exchanger evaporators $4_1$, $4_2$, $4_3$ via the manifold 13 and the magnetic valves $5_1$, $5_2$, $5_3$.

In an alternative form which is also shown in FIG. 5 the source of heat energy originates from a heat recovery exchanger 46 fed at 49 with a hot fluid such as exhaust gases from a heat engine. After cooling in the exchanger 48, this fluid leaves the exchanger through the discharge 50. The exchange surface is represented by 47. The effect of the heat is to vaporize the liquid flowing under gravity from the tank 29 into the exchanger 46 through the intermediacy of the magnetic entry valve 55 and the pipework 45.

The vapor formed in the exchanger 46 returns to the top of the tank 29 through the intermediacy of the pipework 48. The pipework 45 and 48 connecting the tank 29 to the exchanger 46 may be equipped with automatic couplings 51, 52, 53, 54 in order to make the system easier to install. The exchanger 46 may also be a solar sensor.

According to another form of the invention the valves $5_1$, $5_2$, $5_3$, . . . , $6_1$, $6_2$, $6_3$ and 55 may be replaced by thermo-emulsifiers preventing the liquid from returning towards the corresponding evaporator when they operate.

The invention is, of course, not limited to the production of cold; it can also be applied to the production of heat by means of a chemical heat pump.

The invention can be applied especially to the cooling of refrigerated trucks, to the air conditioning of motor vehicles of all kinds, to heating and to the production of hot water.

Furthermore, instead of being cooled by air, the condensers may be cooled by a water cooling circuit.

Moreover, the invention also applies to the production of cold by adsorption between a solid and a fluid.

I claim:

1. A plant for producing cold, using at least one solid and a fluid, comprising at least one reactor containing the solid and connected to an evaporator and a condenser by tubing in which the fluid circulates in a refrigeration cycle, said reactor including cooling means for providing heat exchange with the solid contained in the reactor, said cooling means comprising a heat exchanger filled with the same fluid used in the refrigeration cycle and being connected by tubing to the same condenser used in the refrigeration cycle.

2. Plant in accordance with claim 1, wherein the condensor is capable of heat exchange with a fan.

3. Plant in accordance with claim 1, wherein for each reactor a heat exchanger surrounds the wall of the reactor and defines a vessel with the latter.

4. Plant in accordance with claim 3, further comprising a tank connected by pipework to the bottom of the exchanger of each reactor.

5. Plant in accordance with claim 1, comprising an external source of energy for heating each reactor comprising means of heat exchange which are arranged inside each reactor which communicate by tubing with the said source.

6. Plant in accordance with claim 5, wherein the said means of heat exchange consist of tubing forming a coil inside the reactor.

7. Plant in accordance with claim 5, wherein the heat transfer fluid is heated so as to form an equilibrium between the liquid and vapor phases, the circulation in the means of heat transfer taking place gravitationally.

8. Plant in accordance with claim 7, wherein the fluid is water heated to approximately 200° C. at a pressure of approximately $15\times10^5$ pascals.

9. Plant in accordance with claim 5, this plant being provided on a vehicle with a heat engine, wherein the source of energy is supplied by a regenerator placed in the exhaust of the heat engine.

10. Plant in accordance with claim 5, wherein the means for heating each reactor is the only one and is connected to each reactor via valves making it possible to select the reactor to be heated.

11. Plant in accordance with claim 1, wherein valves are placed in the liquid conduit of the exchangers making it possible to select the reactor to be cooled.

12. Plant in accordance with claim 3, wherein the transfer fluid is ammonia.

* * * * *